US010982676B2

(12) United States Patent
Zielberg et al.

(10) Patent No.: US 10,982,676 B2
(45) **Date of Patent: *Apr. 20, 2021**

(54) COOLANT PUMP FOR THE AUTOMOTIVE INDUSTRY

(71) Applicant: PIERBURG GMBH, Neuss (DE)

(72) Inventors: Stephan Zielberg, Bochum (DE); Michael-Thomas Benra, Castrop-Rauxel (DE); Stefan Rothgang, Rheinberg (DE); Andreas Burger, Krefeld (DE); Helmut Prinz, Neuss (DE)

(73) Assignee: PIERBURG GMBH, Neuss (DE)

( * ) Notice: Subject to any disclaimer, the term of this patent is extended or adjusted under 35 U.S.C. 154(b) by 271 days.

This patent is subject to a terminal disclaimer.

(21) Appl. No.: 15/772,813

(22) PCT Filed: Jul. 21, 2016

(86) PCT No.: PCT/EP2016/067372

§ 371 (c)(1),
(2) Date: May 2, 2018

(87) PCT Pub. No.: WO2017/076524

PCT Pub. Date: May 11, 2017

(65) Prior Publication Data

US 2018/0320692 A1 Nov. 8, 2018

(30) Foreign Application Priority Data

Nov. 6, 2015 (DE) ..... 10 2015 119 097.4

(51) Int. Cl.
*F04D 15/00* (2006.01)
*F04D 5/00* (2006.01)
(Continued)

(52) U.S. Cl.
CPC ..... *F04D 15/0038* (2013.01); *F01P 5/10* (2013.01); *F04D 5/002* (2013.01); *F04D 13/12* (2013.01);
(Continued)

(58) Field of Classification Search
CPC ..... F04D 15/0005; F04D 15/0022; F04D 15/0038; F04D 15/0027; F04D 27/002;
(Continued)

(56) References Cited

U.S. PATENT DOCUMENTS 3,364,860 A 1/1968 Schmitt-Matzen
5,281,088 A 1/1994 Brandt
(Continued)

FOREIGN PATENT DOCUMENTS

CN 1311389 A 9/2001
CN 101749249 A 6/2010
(Continued)

*Primary Examiner* — Richard A Edgar
(74) *Attorney, Agent, or Firm* — Norman B. Thot

(57) ABSTRACT

A coolant pump includes a conveying channel, a drive shaft, a coolant pump impeller arranged on the drive shaft, a control slide which controls a flow cross-section of an annular gap between an exit of the coolant pump impeller and the conveying channel, a side channel pump which includes a side channel pump impeller arranged on the drive shaft and a side channel having an inlet and an outlet where a pressure can be generated by the side channel pump impeller rotating, a pressure channel having a flow cross section which fluidically connects the outlet to a first pressure chamber of the control slide, a valve which closes the flow cross-section, a second pressure chamber arranged on a side of the control slide facing the coolant pump impeller, and a connection channel arranged from the side channel into the second pressure chamber between the inlet and the outlet.

13 Claims, 4 Drawing Sheets

(51) Int. Cl.
*F04D 13/12* (2006.01)
*F01P 5/10* (2006.01)
*F01P 3/00* (2006.01)

(52) U.S. Cl.
CPC ... *F01P 2003/001* (2013.01); *F01P 2005/105* (2013.01); *F05D 2270/64* (2013.01)

(58) Field of Classification Search
CPC .... F04D 27/003; F04D 29/466; F04D 29/468; F04D 13/12; F04D 5/00; F04D 5/002; F01P 5/10
See application file for complete search history.

(56) References Cited

U.S. PATENT DOCUMENTS

| | | | | |
|---|---|---|---|---|
| 6,132,185 | A * | 10/2000 | Wilhelm | F04D 5/002 415/55.1 |
| 10,508,650 | B2 * | 12/2019 | Zielberg | F04D 15/0038 |
| 10,731,654 | B2 * | 8/2020 | Zielberg | F01P 5/10 |
| 2010/0143109 | A1 | 6/2010 | Hartman et al. | |
| 2013/0333863 | A1 | 12/2013 | Pawellek | |
| 2014/0050562 | A1 | 2/2014 | Welte et al. | |

FOREIGN PATENT DOCUMENTS

| | | | |
|---|---|---|---|
| CN | 103459798 | A | 12/2013 |
| CN | 203516133 | U | 4/2014 |
| DE | 15 28 718 | B2 | 3/1976 |
| DE | 43 18 158 | A1 | 2/1994 |
| DE | 692 23 216 | T2 | 3/1998 |
| DE | 10 2011 012 826 | B3 | 1/2012 |
| DE | 10 2010 044 167 | A1 | 5/2012 |
| DE | 10 2012 207 387 | A1 | 1/2013 |
| DE | 10 2013 011 209 | B3 | 1/2014 |
| DE | 10 2012 214 503 | A1 | 2/2014 |
| DE | 10 2013 111 939 | B3 | 10/2014 |
| EP | 2 455 615 | A2 | 5/2012 |
| JP | 51-119604 | | 9/1976 |
| WO | WO 2012/116676 | A1 | 9/2012 |
| WO | WO 2015/062752 | A1 | 5/2015 |
| WO | WO 2016/034159 | A1 | 3/2016 |

* cited by examiner

COOLANT PUMP FOR THE AUTOMOTIVE INDUSTRY

CROSS REFERENCE TO PRIOR APPLICATIONS

This application is a U.S. National Phase application under 35 U.S.C. § 371 of International Application No. PCT/EP2016/067372, filed on Jul. 21, 2016 and which claims benefit to German Patent Application No. 10 2015 119 097.4, filed on Nov. 6, 2015. The International Application was published in German on May 11, 2017 as WO 2017/076524 A1 under PCT Article 21(2).

FIELD

The present invention relates to a coolant pump for the automotive industry, comprising a drive shaft, a coolant pump impeller, which is arranged on the drive shaft at least for conjoint rotation and via which coolant can be conveyed into a conveying channel surrounding the coolant pump impeller, a movable control slide, via which a flow cross-section of an annular gap between an exit of the coolant pump impeller and the conveying channel can be controlled, a side channel pump having a side channel pump impeller, which is arranged on the drive shaft at least for conjoint rotation, a side channel of the side channel pump, in which a pressure can be generated by rotation of the side channel pump impeller, wherein the side channel has an inlet and an outlet, a pressure channel, via which the outlet of the side channel can be fluidically connected to a first pressure chamber of the control slide, a valve, via which a flow cross-section of the pressure channel can be closed and opened.

BACKGROUND

Such coolant pumps serve, for example, in internal combustion engines, to regulate the volume of the coolant conveyed to prevent the internal combustion engine from overheating. These pumps are mostly driven by a belt or chain drive so that the coolant impeller is driven with the speed of the crankshaft or at fixed ratio to the speed of the crankshaft.

In modern internal combustion engines, the volume of coolant conveyed must be adapted to the coolant requirements of the internal combustion engine or the vehicle. In the interest of avoiding increased pollutant emissions and reducing fuel consumption, it is in particular the cold run phase of the engine that should be shortened. This is effected, among other things, by throttling the coolant flow during this phase or by shutting it down completely.

Various pump designs for regulating coolant volume are known. Besides electrically driven coolant pumps, pumps are known that can be coupled with or decoupled from their drive via couplings, in particular hydrodynamic couplings. A possibility for regulating the coolant flow conveyed which is particularly economic and simply designed is the use of an axially displaceable control slide slid over the coolant impeller so that, for a reduction of the coolant flow, the pump does not convey into the surrounding conveying channel, but against the closed slide.

The control of these slides is also provided in different ways. Besides a purely electrical displacement, a hydraulic displacement of the slides has in particular proven itself. A hydraulic displacement is most often effected via an annular piston chamber which is filled with a hydraulic liquid and whose piston is connected to the slide so that the slide is shifted over the impeller when the chamber is filled. The slide is returned by opening the piston chamber towards an outlet, which is most often effected via a magnetic valve, as well as under the effect of a spring which provides the force for restoring the slide.

To avoid having to provide the coolant volume necessary for moving the slide by additional conveying units, such as additional piston/cylinder units, or to compress other hydraulic liquids for the slide operation, mechanically controllable coolant pumps have become known on whose drive shaft a second impeller is arranged via which the pressure for displacing the slide is provided. These pumps are designed, for example, as side channel pumps or servo pumps.

Such a coolant device with a side channel pump acting as a secondary pump is described in DE 10 2012 207 387 A1. In this pump, a slide is situated on the rear of the pump, which slide is displaceable via pressure in an annular chamber and which can be returned via a spring. This annular chamber is formed in a housing which is in turn arranged on the rear of the slide and in which a first side channel of the side channel pump is also arranged which is correspondingly arranged opposite the side channel pump impeller arranged on the shaft. A second side channel is formed in a further housing part on the side opposite the side channel pump impeller. A 3/2-way valve is used in this pump to close a pressure side of the side channel pump in a first position and to connect a suction side of the pump to the cooling circuit and the slide, and, in a second position, to connect the pressure side to the annular chamber of the slide and to connect suction side to the cooling circuit. No detailed channel layout or flow control is disclosed. The schematically illustrated flow controls can be realized in modern internal combustion engines only with increased effort. An increased assembly effort and, above all, an increased installation space requirement also exist for the schematically illustrated flow controls because of the arrangements and housing partings chosen, so that such a pump could not be arranged and mounted in a corresponding design of a cylinder crank case. Another disadvantage of such a pump drivable by the internal combustion engine is that in certain speed ranges, the pressure in the side channel pump is significantly lower than the pressure in the first pressure chamber, which results in the control slide closing the conveying channel despite a demand for coolant. To solve this problem, DE 10 2012 207 387 A1 describes a check valve connected to the pressure side of the side channel pump which opens when the pressure in the side channel pump is too high. It should be clear that such a check valve adds to the complexity of the structure of the coolant pump. Such a check valve also requires additional installation space.

SUMMARY

An aspect of the present invention is to provide a coolant pump for the automotive industry in which the assembly effort and the required installation space are significantly reduced. An aspect of the present invention is also that the coolant flow is provided in any operating situation of the internal combustion engine if so desired.

In an embodiment, the present invention provides a coolant pump for the automotive industry. The coolant pump includes a conveying channel, a drive shaft, a coolant pump impeller arranged on the drive shaft so as to rotate jointly therewith, the coolant pump impeller being configured to convey a coolant into the conveying channel which surrounds the coolant pump impeller, a control slide which is configured to be movable so as to control a flow cross-section of an annular gap arranged between an exit of the coolant pump impeller and the conveying channel, the control slide comprising a first pressure chamber, a side channel pump comprising a side channel pump impeller arranged on the drive shaft so as to rotate jointly therewith, and a side channel which is configured so that a pressure can be generated by a rotation of the side channel pump impeller, the side channel comprising an inlet and an outlet, a pressure channel comprising a flow cross section, the pressure channel being configured to fluidically connect the outlet of the side channel to the first pressure chamber of the control slide, a valve configured to close the flow cross-section of the pressure channel, a second pressure chamber arranged on a side of the control slide facing the coolant pump impeller, and a connection channel arranged from the side channel into the second pressure chamber between the inlet and the outlet.

BRIEF DESCRIPTION OF THE DRAWINGS

The present invention is described in greater detail below on the basis of embodiments and of the drawings in which.

DETAILED DESCRIPTION

Figure 1:
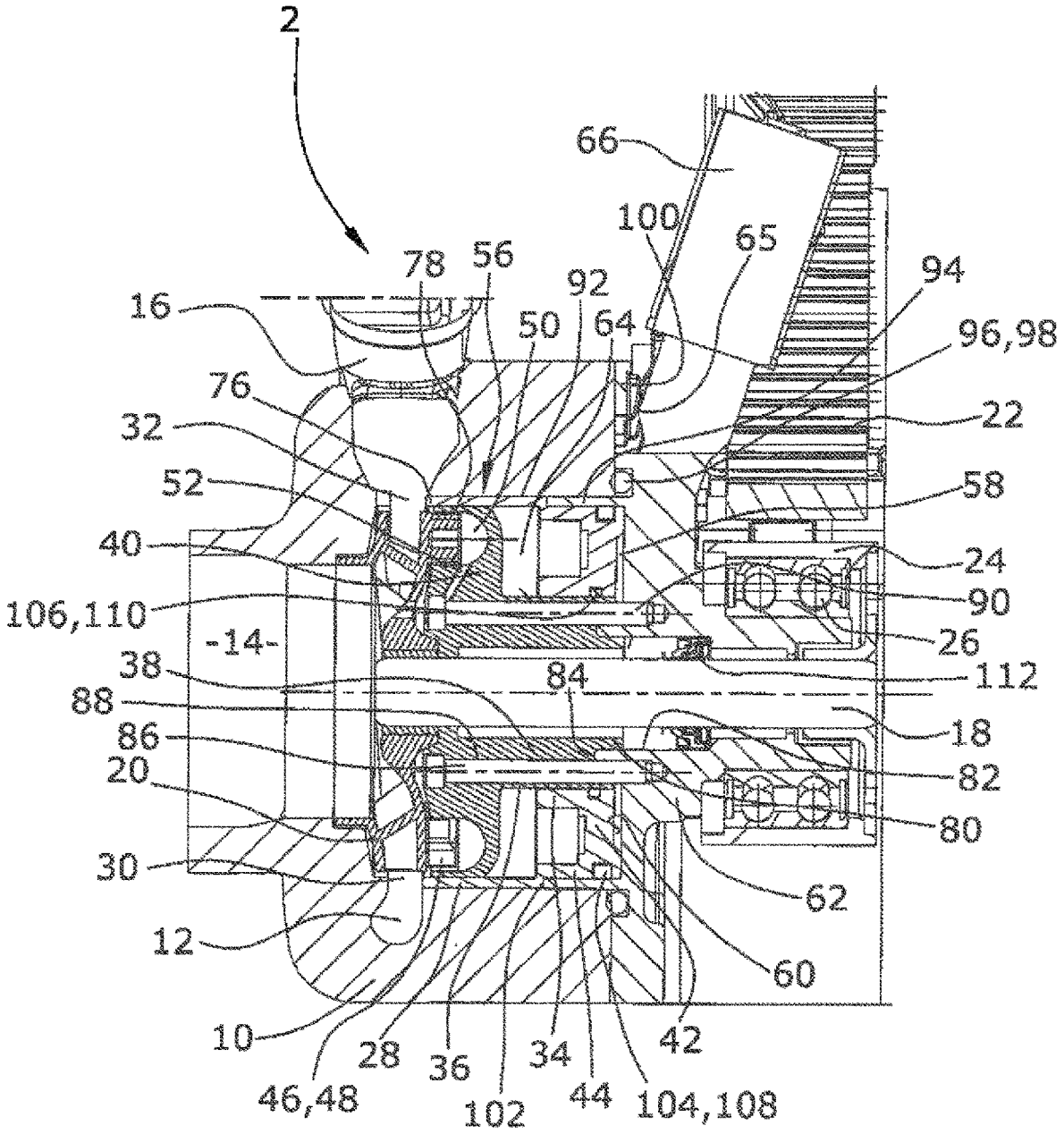
FIG. 1 is a side view of a coolant pump according to the present invention, shown in section.
Figure 2:
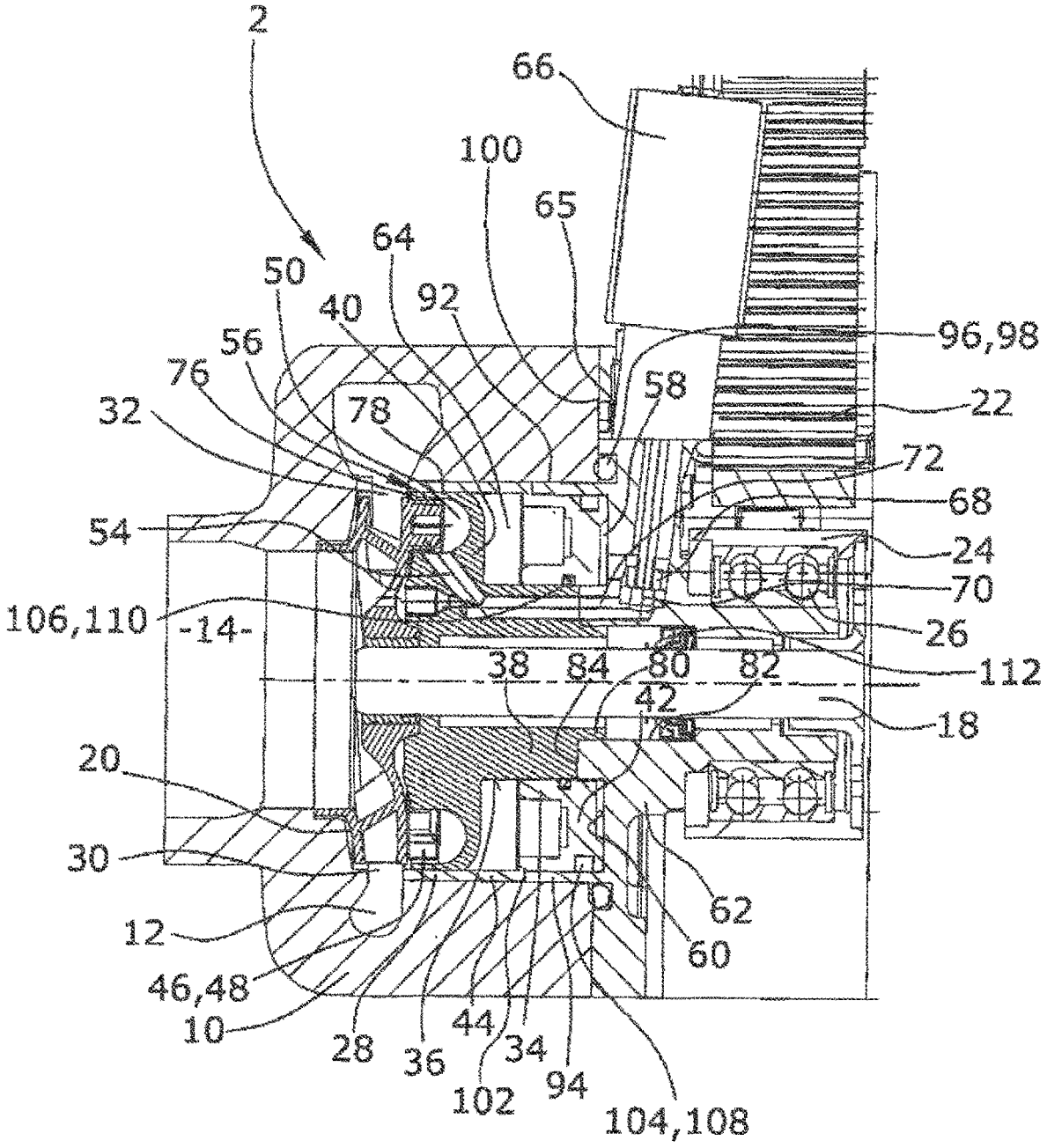
FIG. 2 is a side view of the coolant pump according to the present invention, shown in section and rotated with respect to FIG. 1.

Because a connecting channel from the side channel into a second pressure chamber is provided between the inlet and the outlet, wherein the second pressure chamber is provided on a side of the control side facing the coolant pump impeller, a particularly simple structural solution has been developed for an unfavorable pressure ratio which requires no additional installation space and which is not susceptible to failure.

With regard to a simple manufacture, the connecting channel is designed as a bore. In an embodiment, the connecting channel can, for example, be arranged approximately in the middle between the inlet and the outlet. The connecting channel thus acts as a fail-safe device which provides that, when the magnetic valve is deactivated, the full volume flow of the coolant pump is provided in any operating situation. The exact positioning of the connecting channel depends on the pressure gradient in the side channel.

In an embodiment of a coolant pump of the present invention, the coolant pump impeller can, for example, be formed integrally with the side channel pump impeller and the side channel can, for example, be formed in a first housing part on which the control slide is slidably guided. The required axial installation length is thereby significantly reduced. Assembly steps for fastening the impeller on the shaft are also omitted. The production of one component can also be omitted. The first housing part functions both as a flow housing and as a bearing for the slide so that short pressure channels can be realized.

In an embodiment of the present invention, the blades of the side channel pump impeller can, for example, be formed on a rear side of the coolant pump impeller formed as a radial pump impeller, and the blades can, for example, be arranged axially opposite a side channel. The purely axial orientation of the side channel with respect to the blading reduces the required radial installation space since no radially outer overflow channel is required. Maximum pressure can accordingly be generated with respect to the existing installation space. The second pressure chamber is here advantageously arranged between a bottom of the control slide and a first housing part in which the side channel is provided.

In an embodiment of the present invention, a radially outer delimiting wall of the side channel can, for example, extend axially in the direction of the coolant pump impeller, surround the side channel pump impeller radially, and be radially surrounded by a radially outer delimiting wall of the control slide. This wall correspondingly fills the gap between the slide and the rotating side channel pump impeller and thus between the pressure-generating coolant flow and the conveying flow of the primary pump. This wall can also be used as a guide for the control slide.

It is particularly advantageous if the control slide is slidably guided on an outer surface of an annular, axially extending projection of the first housing part. This projection is correspondingly formed in the radially inner portion of the first housing part and correspondingly allows the control slide to be supported internally on the outer surface which is advantageously machined. This outer surface can, however, also comprise a coating. The use of a sliding material of metal or plastic material is also conceivable. This internal support for the control slide simplifies the installation in a receiving opening of a cylinder crank case whose inner surfaces do not in this case need to be machined. Such an internal guiding also causes a very exact axial movement without the risk of a canting or tilting of the control slide since a sufficiently long guide surface is always available despite the small installation space used.

In an embodiment of the present invention, the first pressure chamber can, for example, be formed on the axial side of the control slide averted from the coolant pump impeller. The displacement of the control slide can accordingly be effected entirely by of hydraulic forces which are merely supplied to the corresponding pressure chambers. No additional annular spaces or piston spaces need to be formed. Due to being delimited by the first housing part, the fluidic connection to the pressure chambers may be established by a simple bore in this housing part, so that additional conduits are not required.

The annular projection of the first housing part can, for example, delimit the two pressure chambers to the radial inner side. No additional sealing is accordingly required in this region. A smooth gapless sliding surface is also obtained.

In an embodiment of the present invention, the pressure channel can, for example, extend through the annular projection of the first housing part so that no further conduits must again be mounted, while the first pressure space can also be connected fluidically to the side channel of the pump directly via the bores in the housing.

The pressure channel advantageously extends from the outlet of the side channel pump through the first housing part and a second housing part into the first pressure chamber, wherein the flow cross section controlled by the valve is formed in the second housing part. Besides forming all of the connecting and pressure channels for controlling the control slide, it is also possible to correspondingly arrange the control valve in the housing so that additional connections to the valve can again be omitted.

In an embodiment of the present invention, the annular projection of the first housing part can, for example, have a shoulder at its axial end from which the annular protrusion extends further in the axial direction with a reduced diameter into a corresponding receiving opening of the second housing part to which the first housing part is fastened. The two housing parts are correspondingly immediately centered with respect to each other by the inner projection, whereby receiving and guiding the control slide is improved. The control slide can be manufactured with small tolerances so that a great tightness can be achieved along the slide, while being guided well on both sides.

A particularly simple and detachable fastening is obtained if the first housing part is fastened to the second housing part via screws.

A coolant pump for the automotive industry is thus provided in which, due to the axial arrangement of the components with respect to each other, a clearly reduced axial installation space is required. The pump is easy to assemble since additional conduits are omitted and fewer parts must be used. The pump is highly reliable since the slide has a reliable guide and support. The coolant pump of the present invention is accordingly simple and economic to manufacture and to assemble.

An embodiment of the coolant pump for an internal combustion engine according to the present invention is shown in the drawings and will be described below.

The coolant pump 2 of the present invention comprises an outer housing 10 in which a spiral-shaped conveying channel 12 is formed, into which a coolant is drawn via an axial pump inlet 14, which is also formed in the outer housing 10, which coolant is conveyed, via the conveying channel 12, to a tangential pump outlet 16 formed in the outer housing 10 and into a cooling circuit of an internal combustion engine. This outer housing 10 may in particular be formed by a cylinder crank housing which has a recess for receiving the rest of the coolant pump 2.

For this purpose, a coolant pump impeller 20 is fastened on a drive shaft 18 radially inside of the conveying channel 12, the coolant pump impeller 20 being designed as a radial pump impeller which, by its rotation, conveys the coolant in the conveying channel 12.

The drive of the coolant pump impeller 20 is provided via a belt 22 driving a pulley 24 fastened at the axial end of the drive shaft 18 that is opposite the coolant pump impeller 20. The pulley 24 is supported by a double row ball bearing 26. A drive via a chain drive is also possible.

In order to be able to change the volume flow conveyed by the coolant pump 2, a control slide 28 is used that is configured to be displaced into an annular gap 30 between an exit 32 of the coolant pump impeller 20 and the surrounding conveying channel 12 and correspondingly controls the flow cross-section available.

Via an inner hollow cylindrical circumferential wall 34, the control slide 28 is slidably supported on a machined outer surface 36 of an annular, axially extending projection 38 of a first inner housing part 40. This inner hollow cylindrical circumferential wall 34 extends from a bottom 42 of the control slide 28 concentrically to a radial outer circumferential wall 44 which extends in the same direction from the bottom 42 and is displaced into the annular gap 30 for volume flow regulation.

For the actuation of the control slide 28, a side channel pump impeller 46 is formed integrally with the coolant pump impeller 20 on the axial side of the coolant pump impeller 20 that is opposite the pump inlet 14, the side channel pump impeller 46 being correspondingly driven together with the coolant pump impeller 20. This side channel pump impeller 46 has blades 48 arranged axially opposite a side channel 50 which is formed in the first inner housing part 40 from which, also in the radially inner region, the annular projection 38 for supporting the control slide 28 extends axially towards the side averted from the coolant pump impeller 20. An inlet 52 and an outlet 54 are formed in the first inner housing part 40 so that the side channel pump impeller 46 forms a side channel pump 56 together with the axially opposite side channel 50, via which side channel pump 56 the pressure of the coolant is increased from the inlet 52 to the outlet 54 of the side channel pump 56.

The coolant conveyed by the side channel pump 56, which generates a hydraulic pressure, can be supplied ether to a first pressure chamber 58 formed on the side of the control slide 28 averted from the coolant pump impeller 20 between the bottom 42 of the control slide 28 and a contact surface 60 of a second housing part 62, or it can be recirculated to the coolant pump 2 via a magnetic valve 66. A speed-dependent hydraulic pressure prevails in a second pressure chamber 64 arranged between the bottom 42 of the control slide 28 and the first housing part 40. To be able to selectively control or regulate the pressures in the pressure chambers 58, 64 via of the coolant conveyed by the side channel pump 56, a recess 65 for the magnetic valve 66 is provided in the second housing part 62 with regard to the second pressure chamber 64, which magnetic valve 66 is designed as a 3/2-way magnetic valve 66 and which is connected to the first pressure chamber 58 so that a flow cross section 70 of a pressure channel 72 is controlled depending on the position of its closing body 68. A connecting channel 74 is provided for the regulation or control of the pressure in the second pressure chamber 64, which connecting channel 74 serves as a fail-safe bore since a pressure is thereby provided in the second pressure chamber 64 which is always higher than the suction pressure of the side channel pump 56.

The pressure channel 72 first extends from the outlet 54 of the side channel 50 of the side channel pump 56 into a radially inner region of the first inner housing part 40 that forms the annular projection 38, and from there, extends axially into the second housing part 62, in which the controllable flow cross section 70 of the pressure channel 72 is formed that can be closed and opened by the closing body 68 of the magnetic valve 66. From this controllable flow cross section 70, the pressure channel 72 extends further into the first pressure chamber 58.

Figure 3:
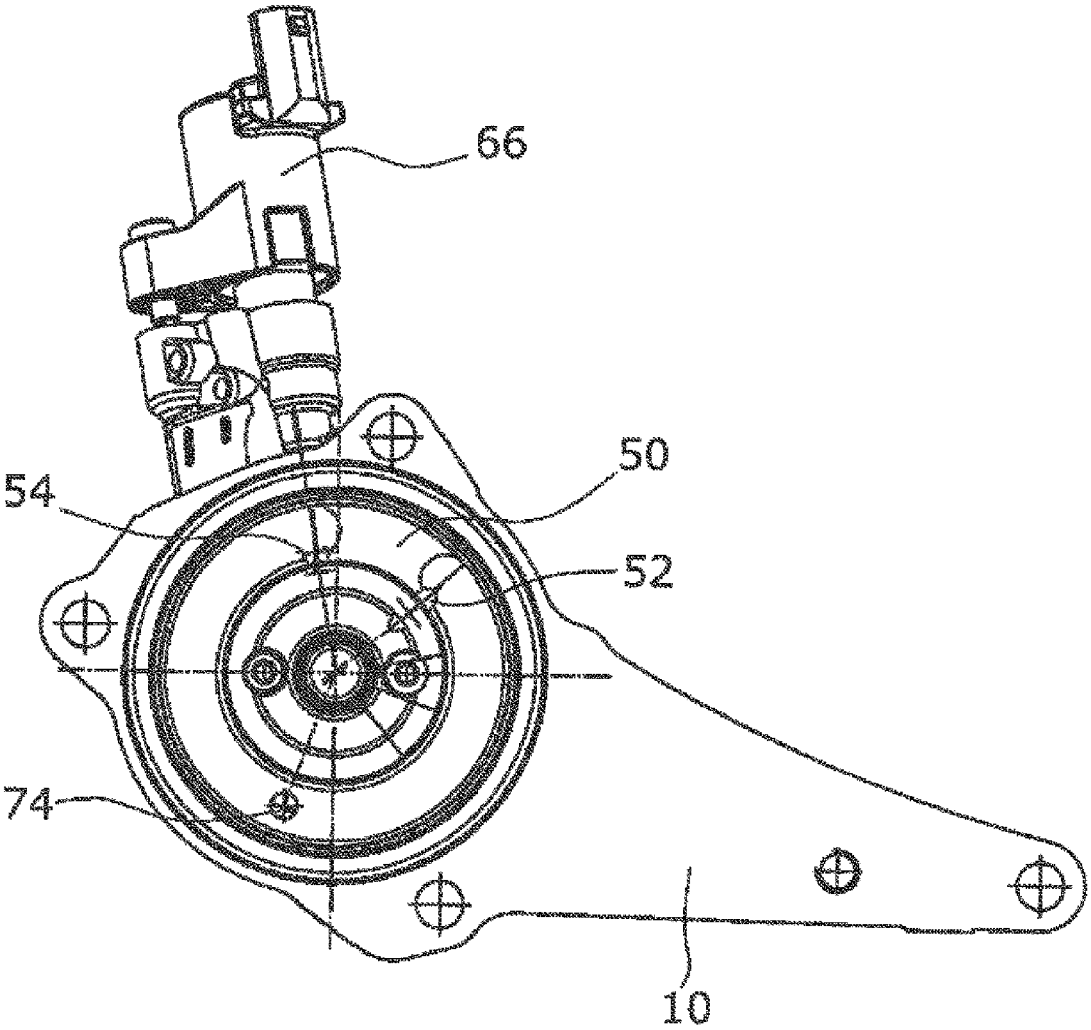
FIG. 3 is a front view cut in the region of a side channel pump of the coolant pump.
Figure 4:
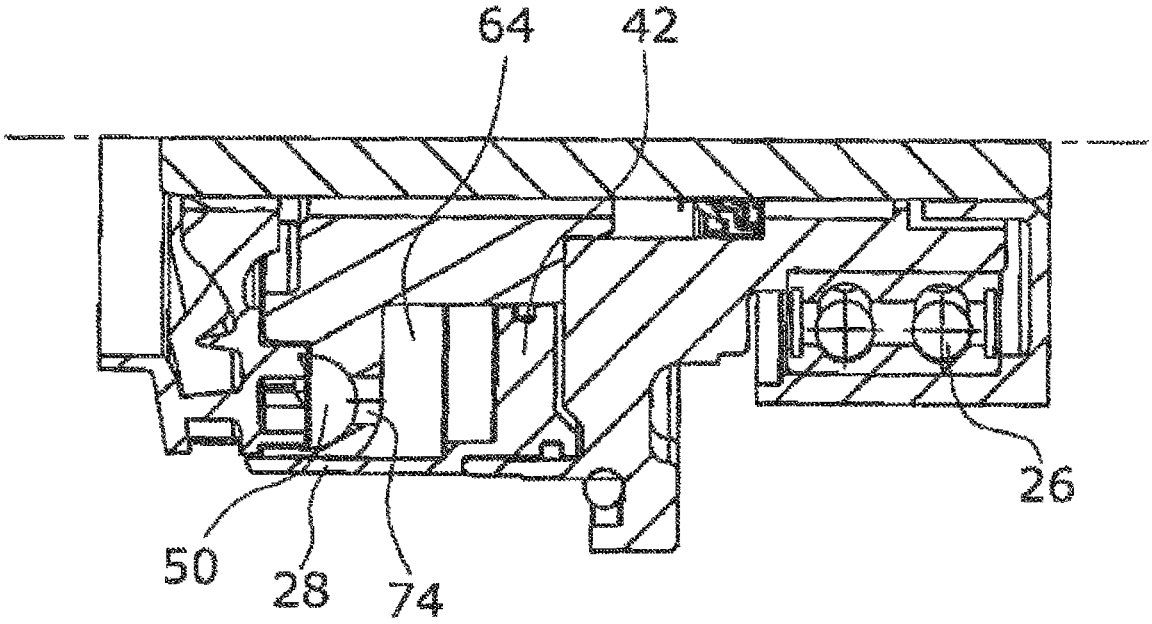
FIG. 4 is a partial view of the coolant pump according to the present invention, shown in section and rotated with respect to FIG. 1.

As can be seen in particular from FIGS. 3 and 4, the second pressure chamber 64 is connected to the side channel 50 via the connecting channel 74 formed in the first housing part 40, wherein this connecting channel 74 extends from a region of the inlet 52 from the side channel 50 directly into the second pressure chamber 64. This connecting channel 74 is situated approximately in the middle between the inlet 52 and the outlet 54, offset by about 150° with respect to the inlet 52. The connecting channel 74 thus acts as a fail-safe device which provides that, with the magnetic valve 66 deactivated or dysfunctional, a speed-dependent pressure prevails in the second pressure chamber 64 in any operating situation, which pressure is always higher than the suction pressure of the side channel pump 56 and thus also higher than that of the coolant pump 2 since this pressure prevails in the first pressure chamber 58. The exact position of the connecting channel 74 depends on the pressure gradient in the side channel 50. A third flow port of the magnetic valve 66 (which is not shown in the drawings) leads to the suction side of the coolant pump 2.

If the coolant pump 2 is to convey a maximum volume of coolant in normal operation, the annular gap 30 at the exit 32 of the coolant pump impeller 20 is fully opened by not energizing the magnetic valve 66, whereby the closing body 68 is shifted by a spring force into its position closing the flow cross section 70 of the pressure channel 72. As a result, no pressure is built up by the coolant in the first pressure chamber 58, but the coolant present in the pressure chamber 58 can flow towards the pump inlet 14 of the coolant pump 2 via the (not illustrated) other flow port of the magnetic valve 66 which is open in this state. Instead, in this state, the side channel pump 56 conveys against the closed flow cross section 70 of the pressure channel 72 with a speed-dependent pressure profile, wherein a corresponding pressure prevails in the second pressure chamber 64 depending on the exact position of the connecting channel 74. This increased pressure in the second pressure chamber 64 results in a pressure difference being generated at the bottom 42 of the control slide 28, which causes the control slide 28 to be shifted into its position clearing the annular gap 30, whereby a maximum conveying of the coolant pump 2 is provided. In the event of a failure of the electric supply to the magnetic valve 66, the control slide 28 correspondingly assumes the same position so that a maximum conveying by the coolant pump 2 is also provided in this emergency operation state without requiring a return spring or another non-hydraulic force therefor.

The coolant from the first pressure chamber 58 can flow off via a return channel (not shown in the drawings) which extends from the magnetic valve 66 through the second housing part 62 and then along the drive shaft 18 inside the first inner housing part 40 and to the pump inlet 14 of the coolant pump 2 via a bore in the coolant pump impeller 20.

When a reduced coolant flow to the cooling circuit is demanded by the engine control, as is the case, for example, during the cold run phase, the magnetic valve 66 is energized, whereby the closing body 68 opens the flow cross section 70 of the pressure channel 72 and reduces or closes the flow cross section between the first pressure chamber 58 and the return channel (not shown in the drawings). The pressure generated at the outlet 54 of the side channel pump 56 is accordingly supplied to the first pressure chamber 58 also though the pressure channel 72 to shift the control slide 28 into the annular gap 30. In this state, a pressure difference correspondingly prevails at the bottom 42 of the control slide 28, which pressure difference is opposite when compared to the other position of the magnetic valve 66 and which causes the control slide 28 to be shifted into the annular gap 30 and the coolant flow in the cooling circuit to be interrupted thereby.

When a controllable magnetic valve 66 is used, it is also possible to move the magnetic valve 66 to intermediate positions, whereby a force equilibrium can be obtained for each position of the control slide 28 so that a complete control of the flow cross section of the annular gap 30 becomes possible.

In order to provide the compact structure by the integral design of the coolant pump impeller 20 and the side channel pump impeller 46 and a tight connection of the channel sections of the pressure channel 72 or the return channel, respectively, formed in the first inner housing part 40 and in the second housing part 62, and to provide the low leakages via the control slide 28 and to thereby provide full controllability, the first inner housing part 40 is fastened directly to the second housing part 52. This is done by pushing the first inner housing part 40 with an annular projection 80, which extends with a reduced diameter from the annular projection 38 further in the end averted from the coolant pump impeller 20, into a radial receiving opening 82 of the second housing part 62 until the first inner housing part 40 abuts the contact surface 60 of the second housing part 62 by its shoulder 84 formed between the projections 38, 80. In this position, the first inner housing part 40 is fastened to the second housing part by screws 86. For this purpose, a plurality of passage bores 88 are formed in the first inner housing part 40 and opposing threaded blind bores 90 are formed in the second housing part 62.

For the fastening of the two housing parts 40, 62 on the outer housing 10 and the resulting arrangement of the control slide 28 in the outer housing 10, the outer housing 10 has an opening 92 at its axial end opposite the axial pump inlet 14 into which opening 92 an annular projection 94 of the second housing part 62 extends so that the annular projection 94 abuts against the inner wall of the opening 92. An axial groove 96 is formed radially outside this hollow cylindrical annular projection 94 in which a sealing ring 98 is arranged which is pressed correspondingly when the second housing part 62 is fastened to the outer housing 10, wherein the second housing part 62 abuts against an outer wall 100 of the outer housing 10 by its contact surface 60.

This annular projection 94 simultaneously serves as a rear abutment 102 for the control slide 28, the end of the radial outer circumferential wall 44 thereof, which is directed to the coolant pump impeller 20, continuing with a slightly larger diameter. At the inner circumference and at the outer circumference of the bottom 42, a radial groove 104, 106 is formed, respectively, in which a respective piston ring 108, 110 is arranged, via which the control slide 28 is slidably supported and correspondingly guided in a sealing manner in the radially inner region on the annular projection 38 of the first inner housing part 40 and in the radially outer region at an inner wall of the hollow cylindrical annular projection 94 of the second housing part 62, which extends into the opening 92 of the outer housing 10.

Thus, after installation, only the rear part of the drive shaft 18, as well as the rear part of the second housing part 62 extends from the opening 92 of the outer housing 10, which second housing part 62 houses the magnetic valve 66 and on which the double-row ball bearing 26 is pressed which supports the pulley 24. The drive shaft 18 extends centrally through the two housing parts 40, 62 with the interposition of a seal 112.

The coolant pump 2 described has an utmost compact structure while still being simple and economic to manufacture and assemble since a low number of parts are used. Additional conduits for a hydraulic connection of the side channel pump to the pressure chambers of the control slide can be omitted since these can be formed by very short paths in the form of simple bores in the two inner housing parts. Due to the fact that the control slide is guided on the housing part in the inner region, which housing part at the same time forms and radially delimits the side channel, the control slide can be guided along this delimiting wall 78 with a clearly defined tolerance 76 and a resultant defined leakage. Owing to the very short axial structure caused by the integral impeller for the side channel pump and the actual coolant conveying pump, the same is particularly suited for direct arrangement in an opening of the crank case.

It should be clear that the scope of protection of the main claim is not limited to the embodiment described, but that various different modifications are conceivable within the scope of protection. For example, only one pressure chamber could be used and the control slide could be returned by a spring. Reference should also be had to the appended claims.

What is claimed is:

1. A coolant pump for the automotive industry, the coolant pump comprising:

a conveying channel;

a drive shaft;

a coolant pump impeller arranged on the drive shaft so as to rotate jointly therewith, the coolant pump impeller being configured to convey a coolant into the conveying channel which surrounds the coolant pump impeller;

a control slide which is configured to be movable so as to control a flow cross-section of an annular gap arranged between an exit of the coolant pump impeller and the conveying channel, the control slide comprising a first pressure chamber;

a side channel pump comprising a side channel pump impeller arranged on the drive shaft so as to rotate jointly therewith, and a side channel which is configured so that a pressure can be generated by a rotation of the side channel pump impeller, the side channel comprising an inlet and an outlet;

a pressure channel comprising a flow cross section, the pressure channel being configured to fluidically connect the outlet of the side channel to the first pressure chamber of the control slide;

a valve configured to close the flow cross-section of the pressure channel;

a second pressure chamber arranged on a side of the control slide facing the coolant pump impeller; and a connection channel arranged from the side channel into the second pressure chamber between the inlet and the outlet.

2. The coolant pump as recited in claim 1, wherein the connecting channel is designed as a bore.

3. The coolant pump as recited in claim 1, wherein the connecting channel is arranged substantially centrally between the inlet and the outlet.

4. The coolant pump as recited in claim 1, further comprising:

a first housing part, wherein, the control slide is further configured to be slidably guided on the first housing part, the coolant pump impeller is formed integrally with the side channel pump impeller, and the side channel is arranged in the first housing part.

5. The coolant pump as recited in claim 4, wherein, the side channel pump impeller comprises blades which are formed on a rear side of the coolant pump impeller, the coolant pump impeller is formed as a radial pump impeller, and the blades are arranged axially opposite to the side channel.

6. The coolant pump as recited in claim 4, wherein the second pressure chamber is arranged between a bottom of the control slide and the first housing part in which the side channel is arranged.

7. The coolant pump as recited in claim 4, wherein, the control slide further comprises an outer circumferential wall, and the side channel further comprises a radially outer delimiting wall which extends axially in a direction of the coolant pump impeller, radially surrounds the side channel pump impeller, and is radially surrounded by the outer circumferential wall of the control slide.

8. The coolant pump as recited in claim 4, wherein the first pressure chamber is formed on an axial side of the control slide which is averted from the coolant pump impeller.

9. The coolant pump as recited in claim 4, wherein, the first housing part comprises an annular, axially extending projection which comprises an outer surface, and the control slide is further configured to be slidably guided on the outer surface of the annular, axially extending projection of the first housing part.

10. The coolant pump as recited in claim 9, wherein the annular, axially extending projection of the first housing part is configured to delimit each of the first pressure chamber and the second pressure chamber radially inwardly.

11. The coolant pump as recited in claim 10, further comprising:

a second housing part, wherein, the pressure channel is further configured to extend from the outlet of the side channel of the side channel pump through the first housing part and the second housing part into the first pressure chamber, and the flow cross section controlled by the valve is formed in the second housing part.

12. The coolant pump as recited in claim 11, wherein, the second housing part comprises a receiving opening;

the second housing part is fastened to the first housing part, and the annular, axially extending projection of the first housing part comprises a shoulder at an axial end from which an annular projection is configured to extend further axially into the receiving opening of the second housing part.

13. The coolant pump as recited in claim 12, further comprising screws configured to fasten the first housing part to the second housing part.

* * * * *